US007180021B2

(12) United States Patent
Birdwell et al.

(10) Patent No.: US 7,180,021 B2
(45) Date of Patent: Feb. 20, 2007

(54) LED ILLUMINATED DOOR CHIME PUSH BUTTON WITH ADJUSTABLE TASK LIGHT

(75) Inventors: Timothy Gale Birdwell, Lafayette, TN (US); Jimmy David Claiborne, Scottsville, KY (US); Roger Dennis Cornett, Bowling Green, KY (US); Scott Blaise Tylicki, Bowling Green, KY (US)

(73) Assignee: Desa IP, LLC, Miami, FL (US)

( * ) Notice: Subject to any disclaimer, the term of this patent is extended or adjusted under 35 U.S.C. 154(b) by 0 days.

(21) Appl. No.: 11/099,407

(22) Filed: Apr. 5, 2005

(65) Prior Publication Data

US 2006/0219541 A1 Oct. 5, 2006

(51) Int. Cl.
*H01H 9/00* (2006.01)

(52) U.S. Cl. ..... 200/310; 200/314

(58) Field of Classification Search ..... 200/310–314, 200/341–345; 362/100, 95, 152, 251, 234, 362/240, 249, 277, 282
See application file for complete search history.

(56) References Cited

U.S. PATENT DOCUMENTS

| | | | | | |
|---|---|---|---|---|---|
| 2,242,626 | A | * | 5/1941 | Silker | 362/100 |
| 2,254,842 | A | * | 9/1941 | Gray | 362/100 |
| 2,856,890 | A | * | 10/1958 | Rinker | 116/141 |
| 3,388,244 | A | * | 6/1968 | Castoe | 362/100 |
| 3,590,234 | A | | 6/1971 | Bartick | |
| 3,787,677 | A | | 1/1974 | Molitor | |
| 4,293,894 | A | | 10/1981 | Blank | |
| 4,400,696 | A | * | 8/1983 | Klingensmith | 340/573.3 |
| 4,475,067 | A | | 10/1984 | Rowe | |
| 5,036,441 | A | * | 7/1991 | Herron | 362/95 |
| 5,079,530 | A | * | 1/1992 | Tsuchiyama | 335/17 |
| 5,179,325 | A | * | 1/1993 | Aragon, Jr. | 315/136 |
| 5,803,581 | A | * | 9/1998 | Brockmann | 362/100 |
| 5,865,301 | A | * | 2/1999 | Kawabe et al. | 200/313 |
| 6,139,053 | A | * | 10/2000 | Knox | 280/735 |
| 6,278,366 | B1 | | 8/2001 | Fletcher et al. | |
| 6,305,814 | B1 | | 10/2001 | Giamas | |
| 6,439,732 | B1 | | 8/2002 | Weisbach et al. | |
| 6,515,240 | B1 | * | 2/2003 | Krishna et al. | 200/5 R |
| 6,590,174 | B2 | * | 7/2003 | Zysnarski et al. | 200/310 |

(Continued)

FOREIGN PATENT DOCUMENTS

| | | |
|---|---|---|
| JP | 1239173 | 9/1989 |

*Primary Examiner*—Elvin Enad
*Assistant Examiner*—Lisa Klaus
(74) *Attorney, Agent, or Firm*—Alexander P. Brackett; John F. Salazar; Middleton Reutlinger

(57) ABSTRACT

An illuminated doorbell pushbutton assembly includes a pushbutton assembly that uses a light source, or a plurality thereof to illuminate the pushbutton. The assembly also includes a user-adjustable rotating task light that can be used to direct light to a door lock, a dark step, or to provide a light for identifying keys. A reflector is rotated through an arc to direct light to the area desired by the user. The assembly further includes an electrical circuit that enables the assembly to be installed with electromechanical or electronic chimes.

5 Claims, 9 Drawing Sheets

U.S. PATENT DOCUMENTS 6,590,176 B2 * 7/2003 Cole et al. ..... 200/341
6,655,811 B2 12/2003 Weisbach et al.
6,828,519 B2 * 12/2004 Bui et al. ..... 200/341
6,876,313 B2 * 4/2005 Hsiung et al. ..... 341/35
2003/0169178 A1 * 9/2003 Jensen et al. ..... 340/815.5
2004/0114384 A1 6/2004 Carter et al.

* cited by examiner

LED ILLUMINATED DOOR CHIME PUSH BUTTON WITH ADJUSTABLE TASK LIGHT

BACKGROUND OF THE INVENTION

1. Field of the Invention

The present invention relates generally to an illuminated doorbell pushbutton, and, more specifically, to an illuminated doorbell pushbutton having a source of light to illuminate the pushbutton and having a source of light to direct illumination towards an area as preferred by the user.

2. Description of the Related Art

Traditional illuminated doorbells have numerous shortcomings. First, many illuminated doorbell pushbuttons only have a single light source fixed in place within the doorbell housing used only to illuminate the button. Second, many illuminated doorbell pushbuttons do not have an associated source of illumination that allows the user to select an area to be illuminated by the doorbell, and the projection of the illumination remains static. Therefore, there is a need for an doorbell with an illuminated doorbell pushbutton and an adjustable reflector to direct the illumination from a light source to an area preferred by the user.

SUMMARY OF THE INVENTION

In view of known deficiencies associated with earlier illuminated doorbells, there is provided in an embodiment of the instant invention an illuminated doorbell pushbutton assembly designed to provide—in concert with an illuminated pushbutton—a user-adjustable reflector that can be directed to reflect light from a separate light source, such as an LED. This structure permits the device to be used to illuminate, for example, a door lock or keyhole, or to provide light for identifying keys, as preferred by the user. The separate light source is mounted in the housing for the device adjacent a movable (i.e., rotatable) reflector mechanism, which then selectively directs the light through a fixed transparent or translucent screen or window extending across a substantial portion of the surface of the housing. The user, by means of a lever accessible from the outside of the housing, can rotate the reflector to a selected position adjacent to the screen to illuminate the desired area. The invention thus provides a great deal of flexibility as to the areas to be illuminated, without requiring any modifications to its mechanism or to the building structure to which it is mounted. The invention can clearly illuminate not only a keyhole while providing a clear light for the selection of the required key, but can also simultaneously maintain an illuminated doorbell pushbutton. The light can be transmitted and projected from the light source in diverging rays, so as to illuminate a range of specific areas near the device.

For a better understanding of the present invention, together with other and further objects thereof, reference is made to the following description, taken in conjunction with the accompanying drawings, and its scope will be pointed out in the appending claims.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENTS

While this invention is susceptible of embodiments in many different forms, there are shown in the Figures and will herein be described in detail, preferred embodiments of the invention with the understanding that the present disclosure is to be considered as an exemplification of the principles of the invention, and is not intended to limit the broad aspects of the invention to the embodiments illustrated.

Figure 1:
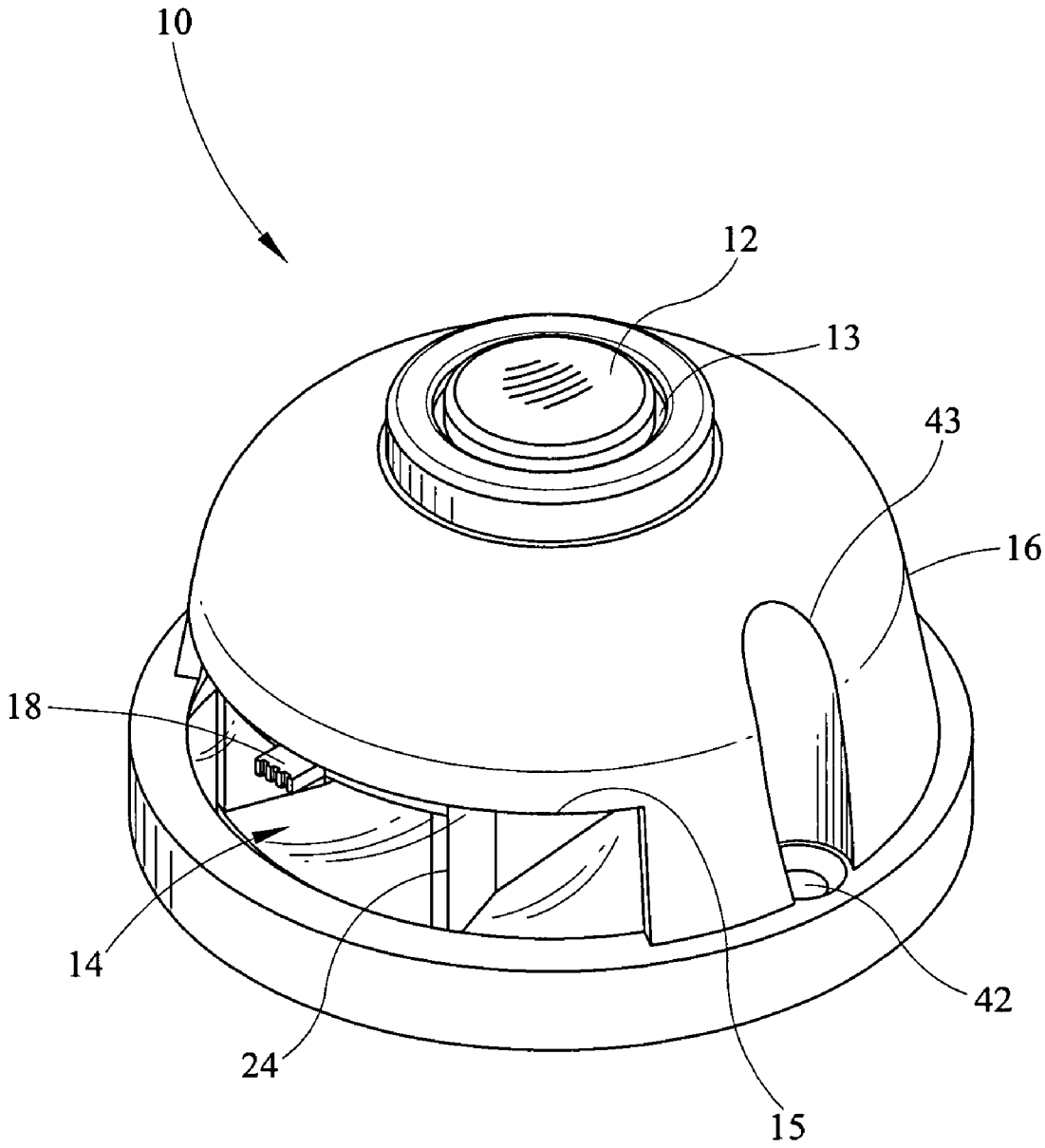
FIG. 1 is a perspective view of an embodiment of the invention showing an illuminated doorbell pushbutton assembly having an adjustable lever in a first position.
Figure 2:
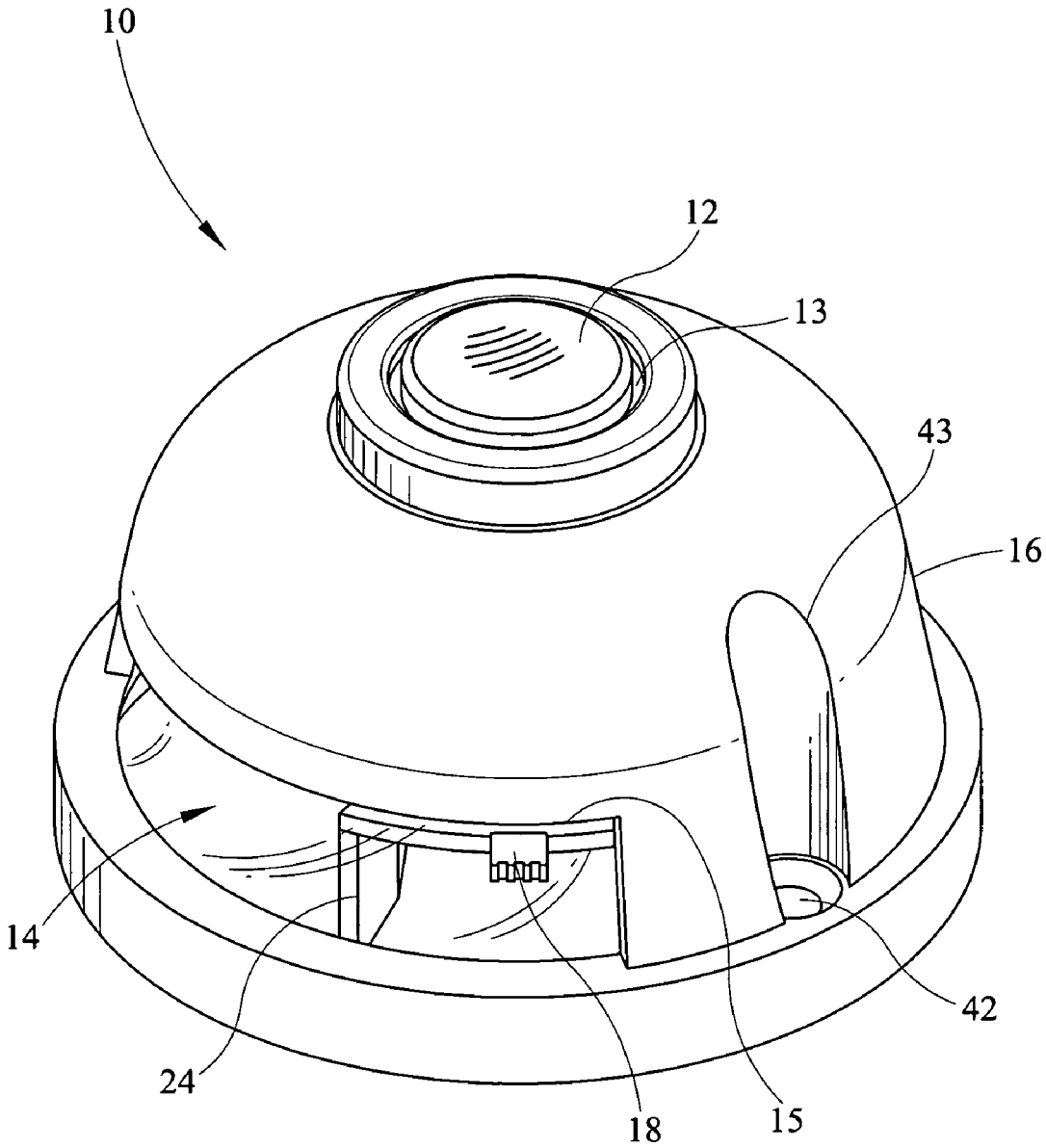
FIG. 2 is a perspective view of the illuminated doorbell pushbutton assembly showing the adjustable lever in a second position.

The present invention, shown in FIGS. 1 and 2, discloses an illuminated doorbell pushbutton assembly (or directional light doorbell) 10 which includes a housing (or casing) 16 having a central aperture 13. The aperture 13 can be positioned in the center of the housing 16. Disposed within the central aperture 13 is a pushbutton assembly 12, which the user presses to actuate door chimes (not shown). A doorbell housing window opening 15 is located on an edge of the housing 16, and is preferably arcuate along the side or edge of the housing 16. The housing 16 may be dome-shaped, although the precise shape of the housing 16 can vary, as long as the shape can include the doorbell housing window opening 15, such as, for example, an opening that is arcuate.

In an alternative embodiment of the present invention the housing 16 may incorporate an integral clear or translucent portion or portions therein in place of the window opening 15 such that light may be readily transmitted therethrough. This feature of the doorbell pushbutton assembly 10 permits light to project out of the translucent portion without the necessity of a separate manufacturing step to incorporate window opening 15. Furthermore, the housing may incorporate an integral light transmitting portion of material proximate the aperture 13 to permit illumination to project outwardly to the pushbutton assembly 12.

The housing 16 shown includes a pair of countersunk openings 42, each forming a funnel shape for receiving the complementary shaped head of a screw (not shown), which allows the head of the screw to lay flush when the housing 16 is mounted to a mounting surface (not shown). The pair of countersunk openings 42 is diametrically opposed at each end of the arcuate doorbell housing window opening 15. The countersunk openings 42 and corresponding receiving channels 43 provide smooth and uncomplicated connection and disconnection of the housing 16 to a mounting surface, while ensuring that the housing 16 is securely locked onto a mounting surface. Any type of fastener sufficient to affix the housing 16 to a mounting surface and support the weight of the illuminated doorbell pushbutton assembly 10 could be utilized, however, such as for example bolts, glue, nails, and rivets. The housing 16 is removably attached to facilitate the replacement of a power source (not shown), which may include a battery, such as button cell batteries known in the art, that can supply sufficient power to the light sources to generate the desired degree and duration of light as discussed further herein below. Alternatively, the assembly 10 of the present invention may be powered from the secondary of an existing transformer, as is common in many door chime systems.

Figure 3:
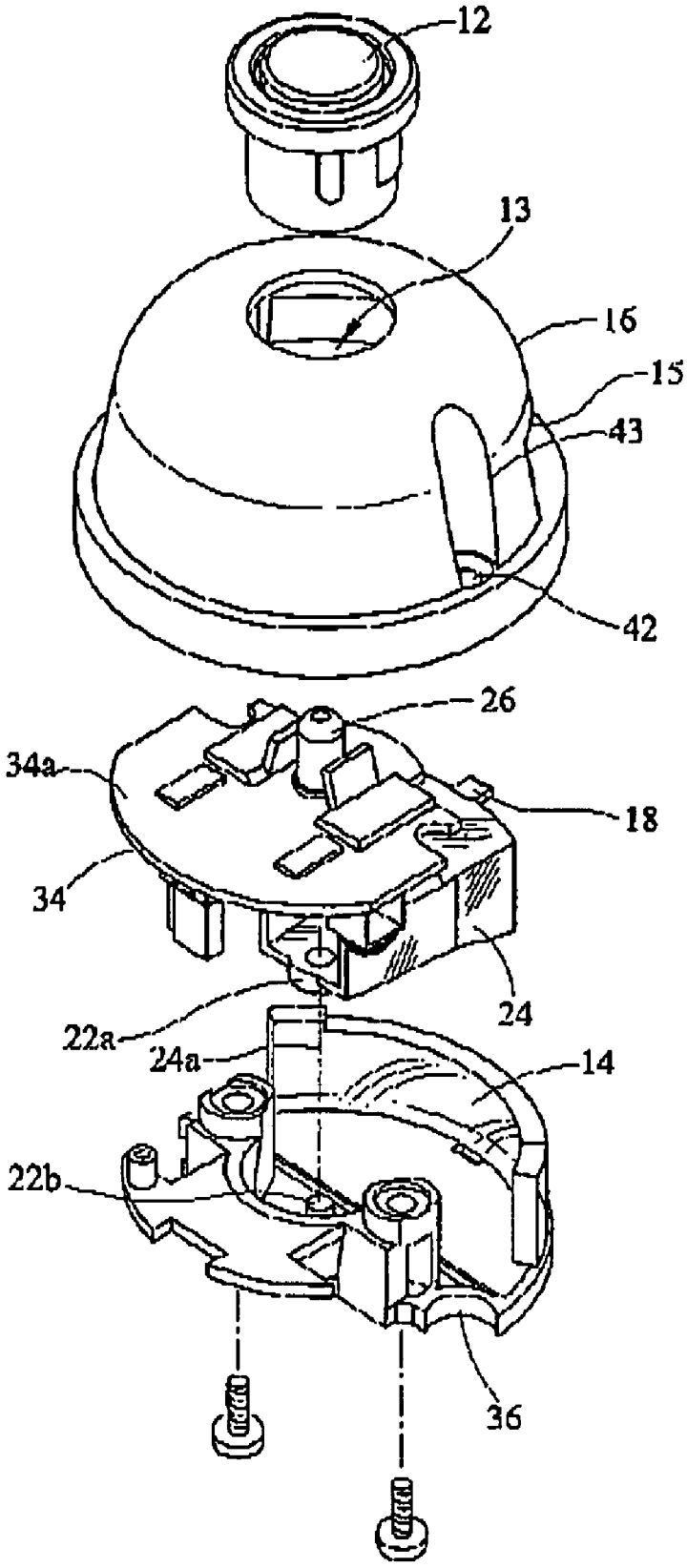
FIG. 3 is a front exploded perspective view of the interior of the illuminated doorbell pushbutton assembly.

Now, referring to FIG. 3, there is shown a front exploded perspective view of the interior of the illuminated doorbell pushbutton assembly 10. A circuit board 34 is disposed within the doorbell housing 16. The circuit board 34 has a top side 34*a*, which faces toward the pushbutton assembly 12, and a bottom side 34*b* (shown more clearly in FIGS. 4 and 5), which faces away from the pushbutton assembly 12. Mounted on the circuit board top side 34*a* is a first light source 26 operatively aligned with the central aperture 13 and the pushbutton assembly 12. The first light source 26 preferably projects illumination up toward the central aperture 13. The first light source 26 illuminates the pushbutton assembly 12, which may be clear, transparent, or translucent, such that illumination from the first light source 26 projects through the pushbutton 12 to enhance visibility of the doorbell pushbutton 12 in a dark environment.

Figure 4:
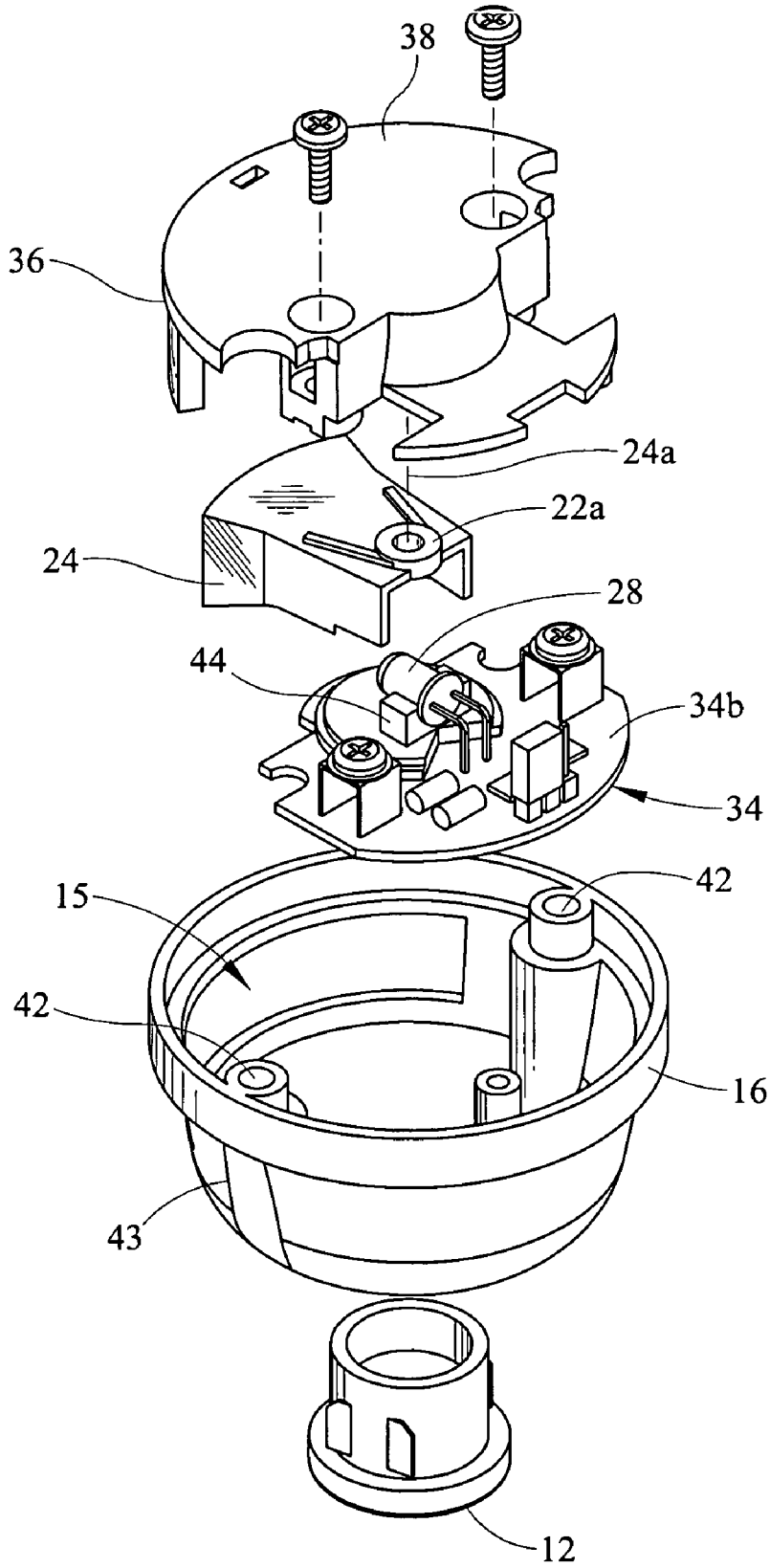
FIG. 4 is a rear exploded perspective view of the interior of the illuminated doorbell pushbutton assembly.
Figure 5:
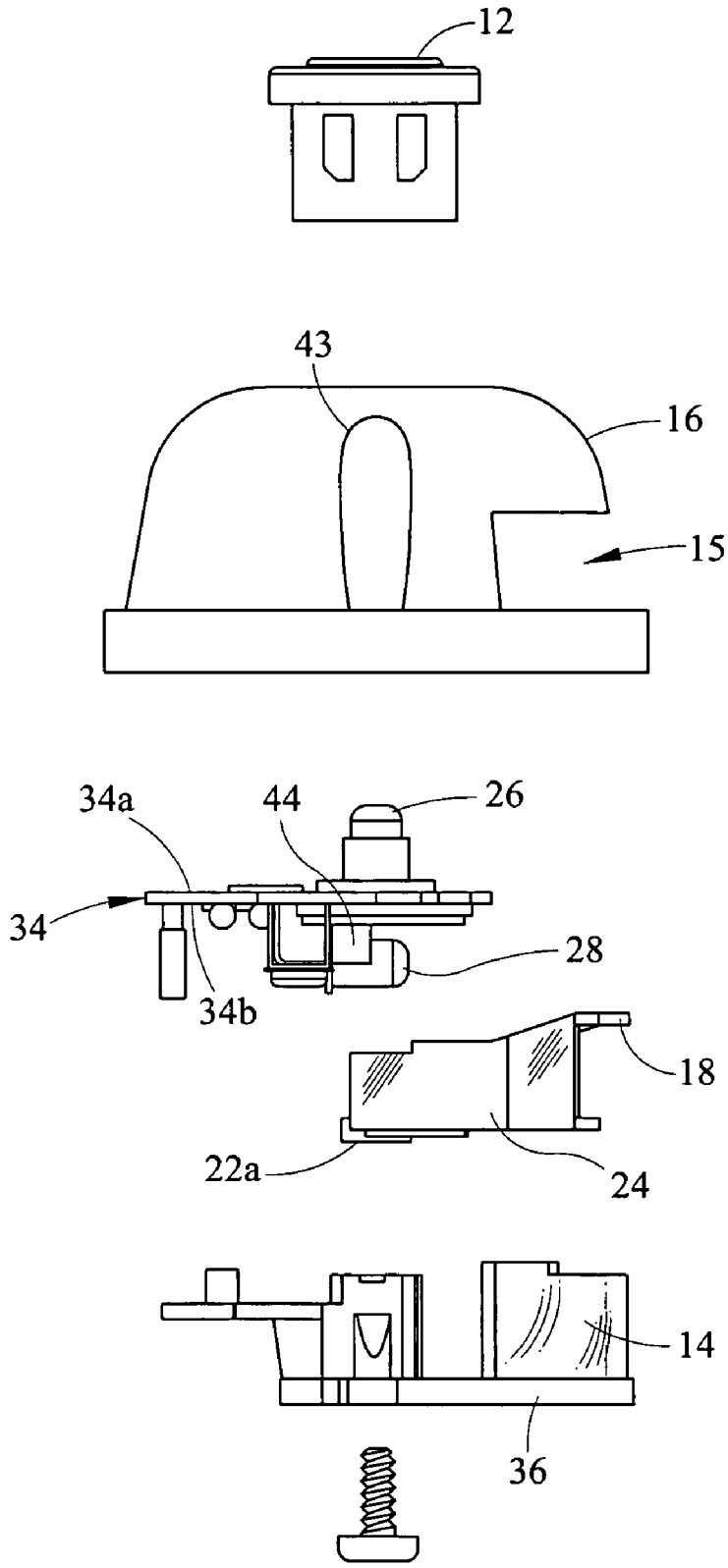
FIG. 5 is a side exploded view of the interior of the illuminated doorbell pushbutton assembly.

Now, referring to FIG. 4, there is shown a rear exploded perspective view of the interior of the illuminated doorbell assembly 10. Mounted on the circuit board bottom side 34*b* is a second light source support 44 which cradles a second light source 28, which generally projects illumination toward the arcuate doorbell housing window opening 15. More specifically, illumination is projected toward an area on the exterior of the illuminated doorbell pushbutton assembly 10 as chosen by the user by moving means for reflecting illumination 24, such as for example an adjustable (rotatable or movable) reflector, mirror, or lens, described in more detail below.

The illuminated doorbell pushbutton assembly 10 also includes a base (or back cover) 36 which is mounted to a mounting surface. The base 36 has a rear wall 38 disposed adjacent to a mounting surface. The base 36 also includes a window 14 (shown more clearly in FIG. 5) which aligns with the doorbell housing window opening 15 of the housing 16 when the illuminated doorbell pushbutton assembly 10 is assembled. The window 14 is preferably arcuate and in operative alignment with the arcuate doorbell housing window opening 15. The window 14 may be constructed of a clear, transparent, or translucent material such as plastic or glass. The adjustable (or rotatable) reflector 24 preferably has a chrome- or mirror-like finish, which reflects the illumination projecting from the second light source 28.

The adjustable reflector 24 rotates or pivots about an axis 24*a* formed by a swivel hinge 22*a* which rotates about a swivel hinge shaft 22*b* (more clearly shown in FIGS. 3 and 5), which projects up from the base 36 into the interior of the housing 16. The swivel hinge 22*a* and swivel hinge shaft 22*b* facilitate the movement of the adjustable reflector 24 about the axis 24*a* and through the range of the arc $\alpha$ (shown more clearly in FIG. 6) of the arcuate doorbell housing window opening 15 and the arcuate window 14. The range of the arc $\alpha$ may be, for example, approximately 75°. A lever 18 (shown more clearly in FIGS. 3 and 5) projects outwardly from the adjustable reflector 24 and protrudes through the arcuate doorbell housing window opening 15 in such a way to avoid interference with the arcuate window 14. The lever 18 is shown in the Figures to protrude through the arcuate doorbell housing window opening 15 above the arcuate window 14, although it is feasible that the lever 18 could be positioned on the opposite side of the adjustable reflector 24 and protrude through the arcuate doorbell housing window opening 15 below the arcuate window 14, or in other positions.

Figure 6:
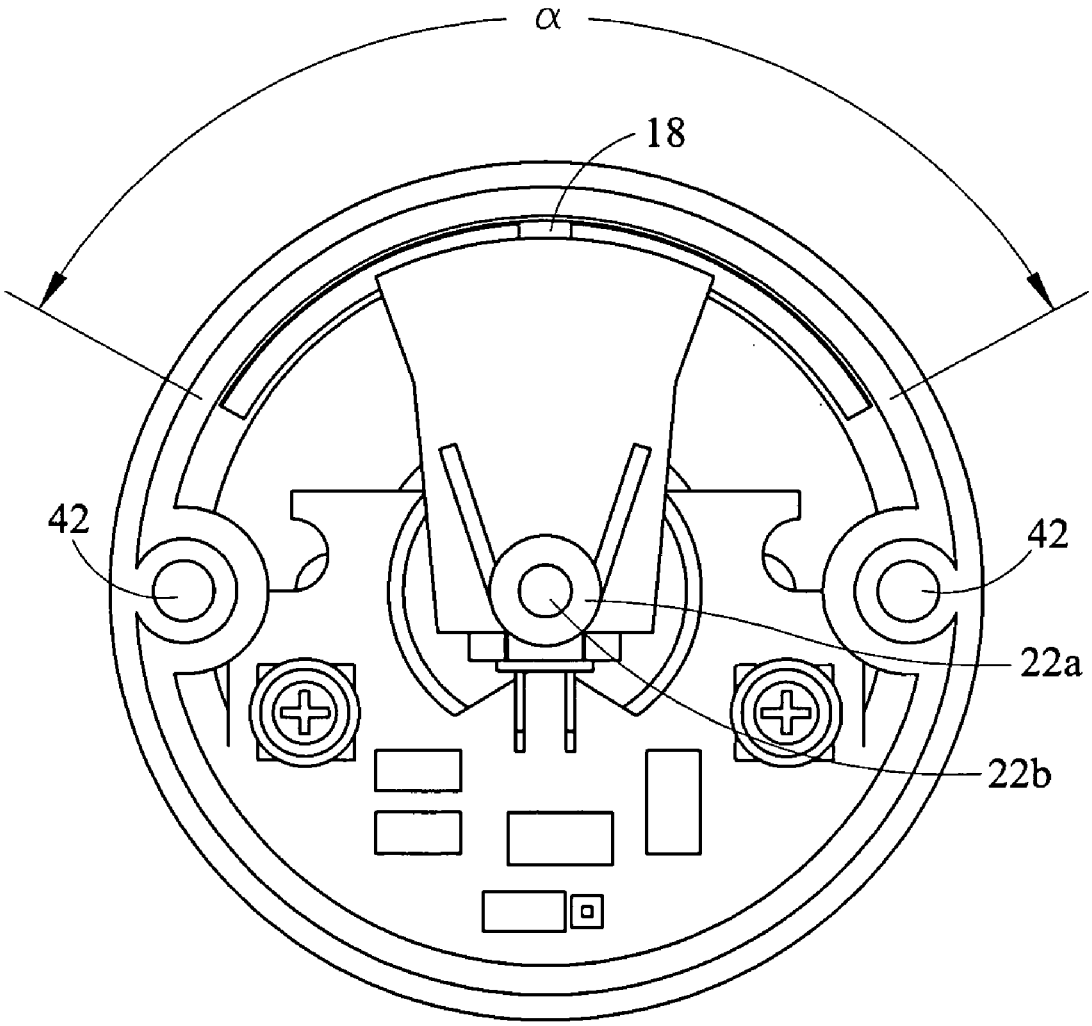
FIG. 6 is a planar rear view of the illuminated doorbell pushbutton assembly.

FIGS. 1, 2, and 6 illustrate the movement of the lever 18. In FIG. 1, the lever 18 is shown in a first position. In FIG. 2, the lever 18 is shown in a second position. FIG. 6 shows the range of movement of the lever 18 through the arc $\alpha$ to provide selective illumination of a range of specific areas near the illuminated doorbell assembly 10. The user can manipulate the lever 18 to move the adjustable reflector 24 at its swivel hinge 22*a* about the swivel hinge shaft 22*b*. The adjustable reflector 24 gathers, focuses, reflects, and projects illumination from the second light source 28. The lever 18 and adjustable reflector 24 direct light to areas remote from the housing 16, such as toward a door lock or keyhole, or to provide a light for identifying keys, as necessary.

Figure 7:
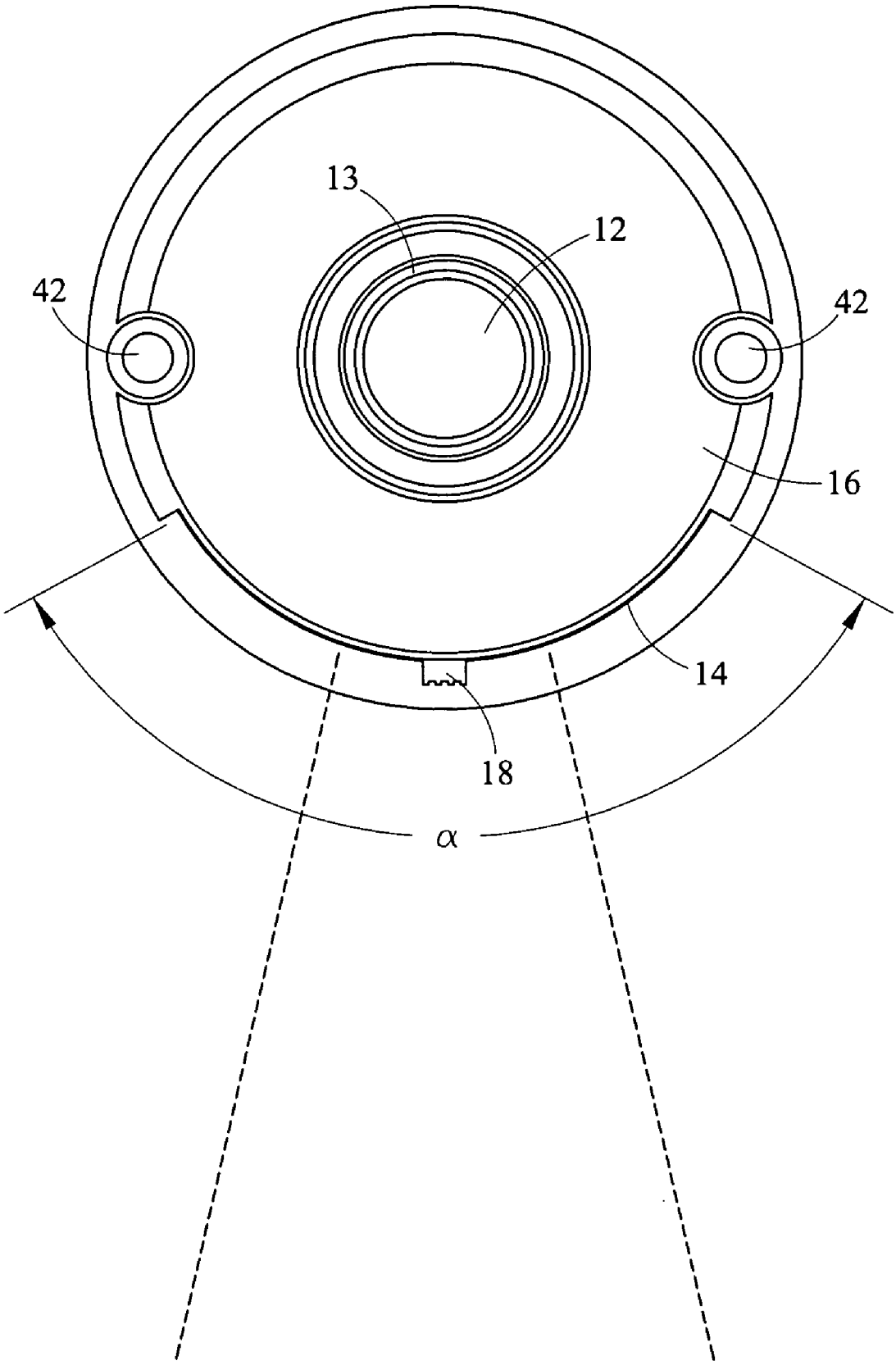
FIG. 7 is a planar front view of the illuminated doorbell pushbutton assembly showing the direction of the illumination in dotted lines.
Figure 8:
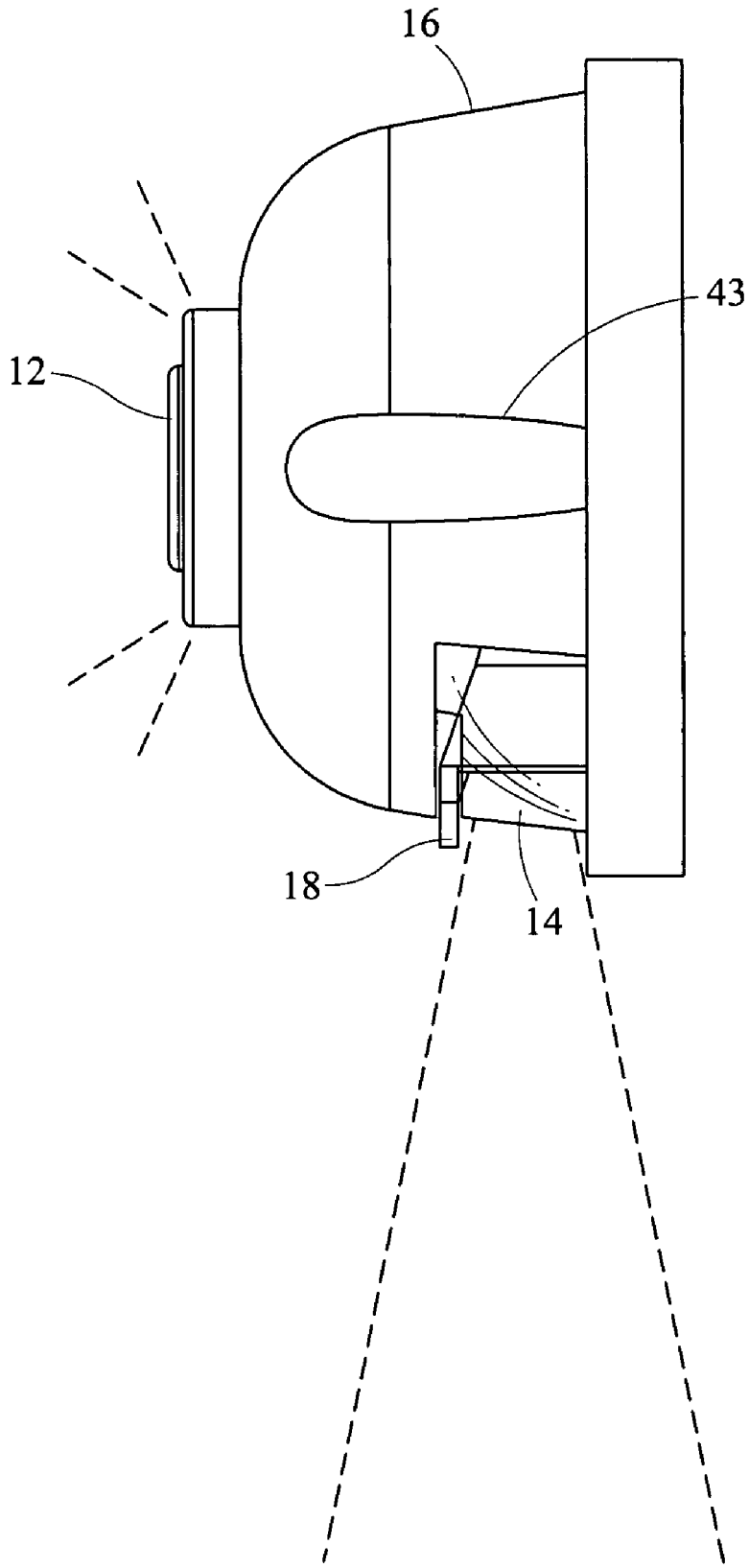
FIG. 8 is a planar side view of the illuminated doorbell pushbutton assembly showing the direction of the illumination in dotted lines.

The first light source 26 and second light source 28, preferably light emitting diodes (LEDs), can be any commonly available bulb, for example an incandescent bulb, as long as each light source provides enough light to sufficiently illuminate, respectively, the push button assembly 12 and a target area as selected by the user. FIGS. 7 and 8 illustrate the projected illumination of the light sources 26, 28. Specifically, FIG. 7 illustrates in dotted lines the projected illumination of the second light source 28 with the lever 18 in a central position in the arc $\alpha$. Also, FIG. 8 illustrates in dotted lines the projected illumination of both the first light source 26 and the second light source 28.

Figure 9:
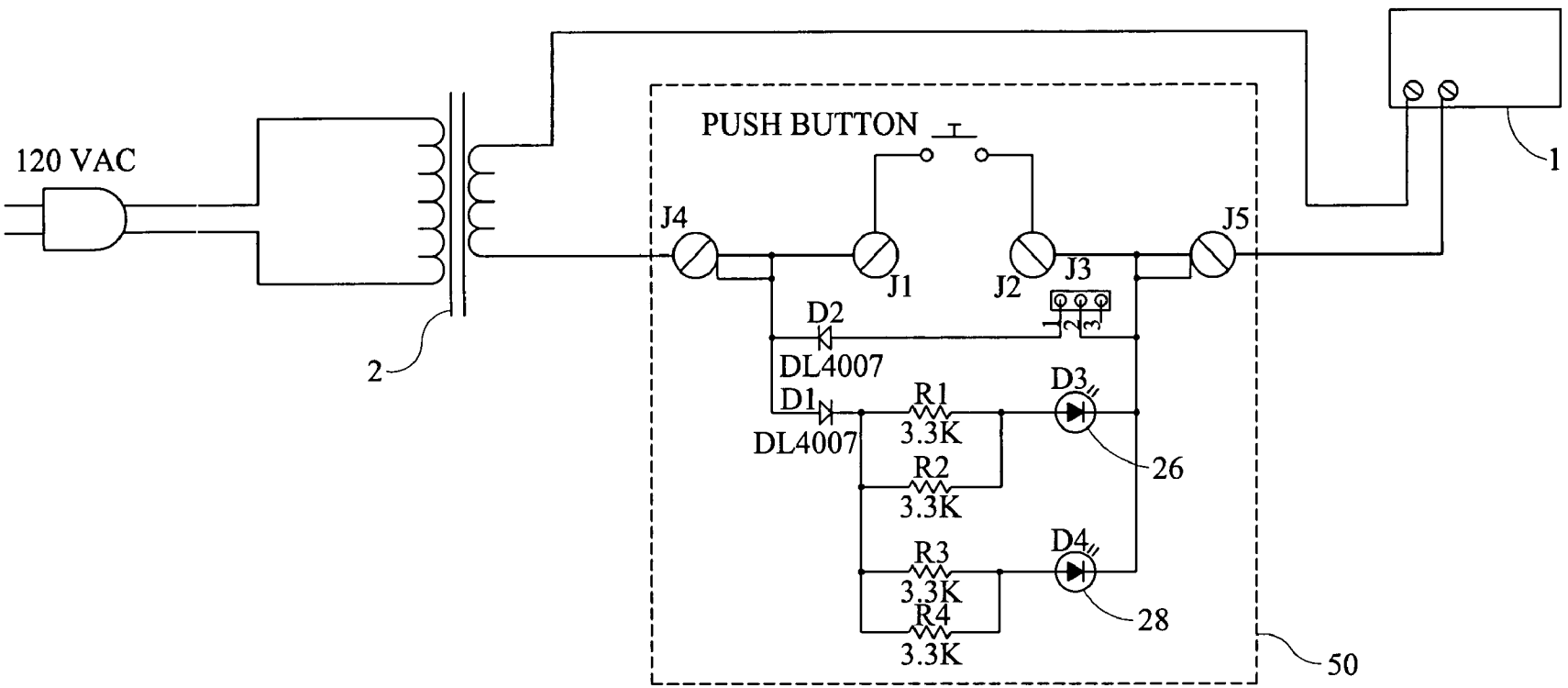
FIG. 9 is a circuit diagram in accordance with one embodiment of the present invention.

Referring now to FIG. 9, and in accordance with a constructed embodiment of the present invention, a circuit 50 for activating a door chime 1 includes pushbutton 12 having a first terminal J1 connected between an electrical power source 2 and a second terminal J2, which is in turn connected to the input terminal of a door chime 3. While one of ordinary skill in the art will recognize that a wide variety of power sources may be employed in conjunction with the present invention, for clarity of discussion the power source 2 shall be the secondary winding of a transformer supplied by 120 VAC, producing, for example, 20 VAC.

When pushbutton 12 is depressed current is conducted to chime 1 thereby initiating the ringing of the chime through a conventional electromechanical actuation system (not shown) as is known in the art. Circuit 50 further comprises a pair of light sources 26 and 28 respectively, shown in FIG. 9 as light emitting diodes D3 and D4. A diode D1 is connected between the transformer 2 and a pair of voltage dividers, resistors R1, R2 and R3, R4 respectively to provide power to LEDs D3 and D4 through one-half of the alternating current cycle. This feature of the present invention enables LEDs D3 and D4 to be powered to provide illumination for the pushbutton assembly.

Voltage divider resistors R1, R2 and R3, R4 may be suitably sized to provide a satisfactory level of illumination depending on the operating characteristics of the LEDs selected. One of ordinary skill in the art will appreciate that a wide variety of conventional incandescent lamps may also be employed as light sources 26, 28 in accordance with an alternative embodiment of the present invention.

The circuit 50 of FIG. 9 further includes a jumper block J3 wherein a jumper may be placed across terminals 1 and 2 thereof in order to electrically couple diode D2 in the circuit 50, in parallel with pushbutton 12. The purpose of this feature of the present invention is to provide power to chime 1 during the time period where pushbutton 12 is not depressed. This feature of the invention permits the doorbell pushbutton assembly 10 to be compatible with many electronic chime systems presently in use. Where an electromechanical chime is employed, the jumper can be placed on terminals 2 and 3 of jumper block J3, thereby electrically decoupling diode D2 from the circuit 50. Additionally, a switch or dip switch may readily be employed in place of jumper block J3 in order to quickly and easily couple or decouple diode D2 from the circuit 50. Accordingly, it may be readily seen that the present invention may be used with a variety of known-in-the art chime systems, simply by selecting the appropriate jumper (or switch) position.

In a yet further embodiment of the present invention, the circuit 50 of FIG. 9 may be installed in concert with a non-illuminated pushbutton, without the necessity of using diode D1 to supply power to the voltage dividers to illuminate lamps as disclosed hereinabove. In this embodiment of the invention, only diode D2 is required, in parallel with pushbutton 12, to provide power to chime 12 during the timer period where pushbutton 12 is not depressed. Diode D2 is electrically coupled to circuit 50 by jumper J3, or alternatively a switch, such that it may be electrically removed from circuit 50 in the event an electromechanical chime is employed.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

We claim:

1. A doorbell assembly comprising:

a doorbell housing having first and second apertures therein;

a doorbell pushbutton assembly having a portion capable of transmission of light, said assembly disposed within the first aperture of said housing;

a light source disposed within said housing to provide illumination to said pushbutton assembly and the second aperture;

a window disposed in said doorbell housing covering said second aperture; and an adjustable reflector secured within said doorbell housing for reflecting illumination from said light source, said adjustable reflector including a lever depending therefrom for aligning said reflector to project illumination through said window.

2. A doorbell assembly comprising:

a doorbell housing having an aperture therein, a first light transmitting portion proximate said aperture and a second light transmitting portion disposed therein;

a doorbell pushbutton assembly disposed within the aperture of said housing;

a first light source disposed within said housing to project illumination to the light transmitting portion of said housing to illuminate said pushbutton assembly;

a second light source disposed in said doorbell housing to provide illumination that projects through the second light transmitting portion thereof; and an adjustable reflector secured within said doorbell housing for reflecting illumination from said second light source, said adjustable reflector including a lever depending therefrom for aligning said reflector to project illumination through said second light transmitting portion of said doorbell housing.

3. A doorbell assembly as claimed in claim 2 wherein illumination from said second light source projects through the second light transmitting portion to illuminate an area proximate said doorbell assembly.

4. A doorbell assembly comprising:

a doorbell housing having an aperture therein, a first light transmitting portion proximate thereto, and a second light transmitting portion therein;

a doorbell pushbutton assembly positioned within the aperture of said housing thereby enabling actuation of said pushbutton;

a light source positioned within said doorbell housing to project illumination to the first light transmitting portion of said housing; and an adjustable reflector positioned within said doorbell housing for reflecting illumination from said light source through said second light transmitting portion of said doorbell housing.

5. A doorbell assembly as claimed in claim 4 comprising:

a lever depending from said adjustable reflector for aligning said reflector to project illumination through said second light transmitting portion of said doorbell housing at a plurality of angles.

* * * * *